United States Patent [19]

McVey

[11] 4,025,812

[45] May 24, 1977

[54] ALUMINA CERAMIC ALKALI METAL LAMP HAVING METAL GETTER STRUCTURE

[75] Inventor: Charles I. McVey, Shaker Heights, Ohio

[73] Assignee: General Electric Company, Schenectady, N.Y.

[22] Filed: Aug. 2, 1976

[21] Appl. No.: 710,896

Related U.S. Application Data

[63] Continuation-in-part of Ser. No. 622,099, Oct. 14, 1975, abandoned.

[52] U.S. Cl. ..... 313/176; 313/174; 313/178

[51] Int. Cl.[2] ..... H01J 61/24

[58] Field of Search ..... 313/176, 174, 178

[56] References Cited

UNITED STATES PATENTS

| | | | |
|---|---|---|---|
| 2,749,462 | 6/1956 | Kenty et al. | 313/25 |
| 2,926,981 | 3/1960 | Stout et al. | 316/25 |
| 3,384,798 | 5/1968 | Schmidt | 313/184 |

OTHER PUBLICATIONS

Stout et al., "Journal of Applied Physics," Dec. 1955, pp. 1488–1492.

*Primary Examiner*—Rudolph V. Rolinec
*Assistant Examiner*—Darwin R. Hostetter
*Attorney, Agent, or Firm*—Ernest W. Legree; Lawrence R. Kempton; Frank L. Neuhauser.

[57] ABSTRACT

A high pressure sodium vapor lamp utilizing an alumina arc tube within an outer envelope has a getter structure comprising a niobium portion operating in a high temperature range and a titanium portion operating in a lower temperature range. The niobium portion includes a connection extending from a niobium end closure structure of the arc tube to the titanium portion. The titanium portion may form one of the lead supports within the outer envelope or it may merely extend along one of the lead supports. This eliminates the need for the conventional barium getter flash which tends to coat the outer envelope and absorb light.

11 Claims, 3 Drawing Figures

ALUMINA CERAMIC ALKALI METAL LAMP HAVING METAL GETTER STRUCTURE

The invention relates to high pressure metal vapor arc lamps and more particularly to alkali metal vapor lamps utilizing alumina ceramic envelopes, and is a continuation-in-part of my copending application Ser. No. 622,099, filed Oct. 14, 1975, same title and same assignee, and now abandoned.

BACKGROUND OF THE INVENTION

High intensity alkali metal vapor lamps of the present kind are described in U.S. Pat. No. 3,248,590 - Schmidt, entitled "High Pressure Sodium Vapor Lamp." These lamps utilize a slender tubular envelope of light-transmissive ceramic resistant to sodium at high temperatures, suitably high density polycrystalline alumina or synthetic sapphire. The filling comprises an amalgam of sodium and mercury along with a rare gas to facilitate starting. The ends of the alumina tube are sealed by suitable closure members affording connection to thermionic electrodes which may comprise a refractory metal structure activated by electron emissive material. The ceramic arc tube is supported within an outer vitreous envelope or jacket generally provided at one end with the usual screw base. The electrodes of the arc tube are connected to the terminals of the base, that is to shell and center contact.

High pressure sodium vapor lamps are vacuum jacketed in order to conserve heat and maximize efficacy. The common practice since the commercial advent of the high pressure sodium vapor lamp has been to evacuate the outer envelope, flash a getter, suitably of barium or barium aluminum alloy, and seal it off. The getter is provided as a powder which is pressed into channeled rings which are flashed by coupling radio-frequency energy into them. Such getter rings are shown for instance in U.S. Pat. No. 3,384,798 — Schmidt, of May 1968, "High Pressure Saturated Vapor Sodium Lamp Containing Mercury".

STATEMENT OF PROBLEM

The barium flash getters which have been used up to now have several drawbacks. They are relatively costly and require tedious hand mounting and alignment. A precise and difficult radio-frequency flashing schedule must be followed. The channeled rings are structurally weak and may occasionally cause lamp failure through short circuit as a result of shock and vibration. Barium has poor hydrogen sorption and this may contribute to sodium cleanup and voltage rise. The barium flash deposits an opaque layer on the lower end of the outer envelope which absorbs a small but substantial proportion of the light output, frequently as much as 8%.

The object of the invention is to provide an improved getter for this lamp which may be used in lieu of the barium getter, or as a supplement thereto where stringent exhaust conditions are specified.

SUMMARY OF INVENTION

In accordance with my invention, I provide a metal getter structure comprising one metal portion operating in a high temperature range and another metal portion operating in a lower temperature range, the two portions being either bonded together or joined by an intermediate member. For the high temperature portion, the metals are chosen from group VB of the Periodic Table comprising vanadium, niobium, and tantalum, and for the low temperature portion the metals may be chosen from either group VB or from group IVB comprising titanium, zirconium and hafnium. The intermediate member may be metal from either group. These metals have a high affinity for contaminants such as hydrogen, oxygen, nitrogen, carbon dioxide, carbon monoxide and water vapor. Preferably niobium is used for the high temperature portion and titanium for the lower temperature portion.

In a preferred embodiment, the intermediate portion is a niobium connector extending from a niobium closure of the arc tube to a titanium portion which for convenience forms one of the lead supports within the outer envelope. The niobium closure operates in the temperature range from about 500° to 1100° C while the titanium portion operates in the temperature range from about 200° to 500° C and serves as a reservoir for the storing of contaminants.

In another construction embodying the invention which is preferred for larger sizes of lamps, the portion operating in the lower temperature range is of titanium but has no structural role. It is merely disposed to extend alongside the conventional structural member and serves as a getter in the manner previously described.

DESCRIPTION OF PREFERRED EMBODIMENT

Figure 1:
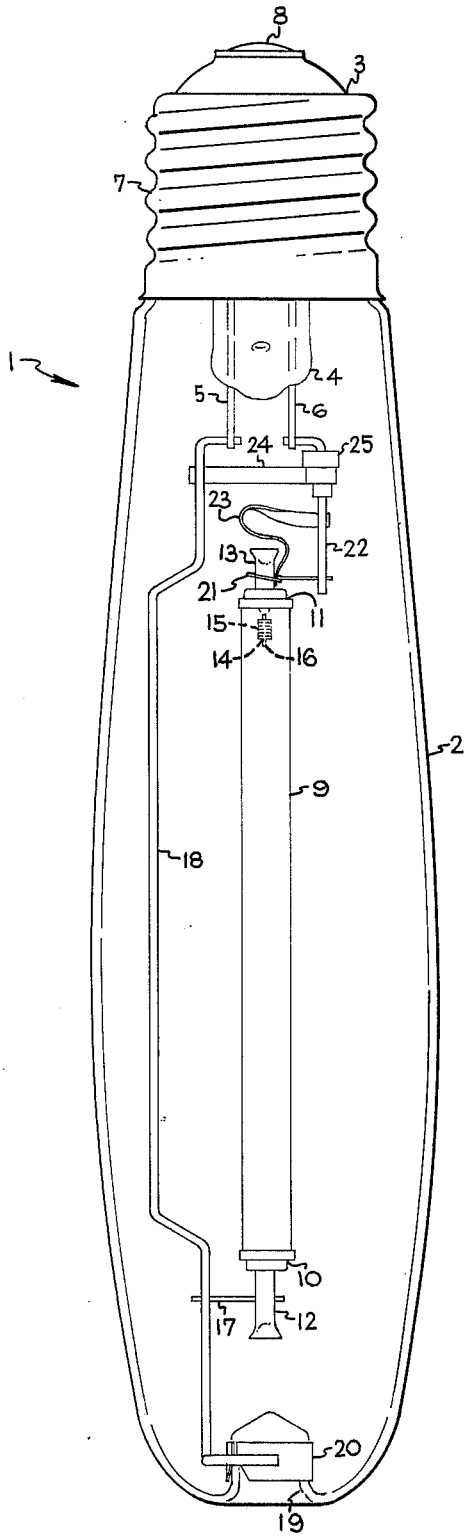
FIG. 1 illustrates a jacketed high pressure sodium vapor lamp embodying the invention and intended for base-up operation.

A high pressure sodium vapor lamp of 400 watt rating embodying the invention in preferred form is illustrated in FIG. 1. The lamp 1 comprises an outer envelope 2 of glass to whose neck is attached a standard mogul screw base 3. The outer envelope comprises a re-entrant stem press 4 through which extend, in conventional manner, a pair of relatively heavy lead-in conductors 5, 6 whose outer ends are connected to the screw shell 7 and eyelet 8 of the base.

The arc tube 9 centrally located within the outer envelope comprises a length of alumina ceramic tubing which may be either monocrystalline and clear or polycrystalline and translucent. The tube has its ends closed by end caps 10, 11 of metal which matches closely the expansion coefficient of the alumina ceramic to which it is sealed by a glassy sealing composition. Niobium is preferred for the end caps but tantalum is also suitable. The lower end cap 10 has a metal tube 12 sealed through it which serves as an exhaust and fill tubulation during manufacture of the lamp. It is then pinched and sealed off at its outer end and serves as a reservoir in which excess sodium, mercury amalgam condenses as a liquid during operation of the lamp. Niobium is preferred for the metal tube but tantalum is also suitable. The upper end cap 11 also has a similar metal tube 13 sealed through it but which does not open into the interior of the arc tube. For this reason tube 13 is referred to as the dummy exhaust tube and it need not be hermetically sealed off at its outer end. The inward projections of tubes 12 and 13 into the arc tube support the electrodes. Upper electrode 14 is illustrated and consists of double layer windings 15 of tungsten wire on a tungsten shank 16 which is welded in the crimped end of the dummy tube. The electrode windings may be activated with $Ba_2CaWO_6$ contained in the interstices between turns. The filling in the lamp comprises an inert gas, suitably xenon if maximum efficiency is desired, or alternatively a Penning mixture such as neon with a fractional percentage of argon if an easier starting lamp operating at a lower efficiency is acceptable. A typical metal charge may consist of about 25 milligrams of amalgam containing from about 9 to 30 weight percent sodium and the remainder mercury.

The illustrated lamp is intended for base-up operation and has exhaust tube 12 rigidly connected by short wire connector 17 to support side rod 18 which is attached to lead-in conductor 5 at the stem end and braced to inverted nipple 19 in the dome end of the envelope by a clip 20 which engages it. Provision for thermal expansion of the alumina arc tube is made by extending dummy exhaust tube 13 at the upper end through a ring or P-shaped support 21 attached to support rod 22 which in turn is welded to lead-in conductor 6. A flexible metal strap 23 spot welded to the dummy exhaust tube and to support rod 22 assures a good electrical contact to the upper electrode. Support rod 22 is braced by strap 24 which wraps around insulator 25 through which the rod extends.

My invention provides an improved getter for this lamp which avoids the disadvantages of the barium flash. The getter utilizes metal from groups VB and IVB of the Periodic Table, and comprises a first portion operating in a high temperature range and a second portion operating in a lower temperature range. In the illustrated embodiment preferred for a base-up operating lamp, the first portion comprises end cap 11, dummy exhaust tube 13 and part of flexible metal strap 23, all made of niobium, and operating in the temperature range from about 500° to 1100° C. The second portion comprises the other part of metal strap 23 and support rod 22 which is made of titanium and operates in the temperature range from about 200° to 500° C. The flexible strap serves as an intermediate member spanning the two ranges. Prior to my invention, support rod 22 was generally made of nickel-iron alloy or other non-gettering metal. The support rod may be made of zirconium which makes an effective getter; however Zr is difficult to weld and can burst into flame when being welded in air.

Figure 2:
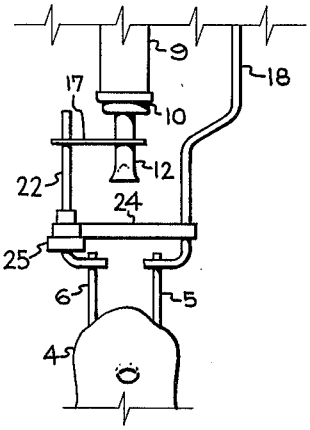
FIG. 2 is a detail of a similar lamp intended for base-down operation.

The detail in FIG. 2 illustrates an embodiment preferred for base-down operation. The arc tube 9 and its immediate connectors are inverted relative to the outer envelope 2 so that exhaust tube 12 is at the stem press end. In this arrangement connector 17 of niobium is welded to niobium exhaust tube 12 at one end and to titanium support rod 22 at the other. A thermal expansion mounting corresponding to that illustrated in FIG. 1 is provided at the opposite end. In this embodiment, the first portion operating in a higher temperature range comprises end cap 10, exhaust tube 12 and part of connector 17 all made of niobium, while the second portion operating in a lower temperature range comprises part of niobium connector 17 and support rod 22 which is made of titanium.

Stout and Gibbons in Journal of Applied Physics, Vol. 26, No. 12, pages 1488 to 1492, December 1955, Gettering of Gas by Titanium, recommend that titanium be used over a temperature gradient for most effective gettering of gaseous contaminants such as oxygen, water vapor and hydrogen. However I have found that in a lamp of the present kind, a getter structure comprising a niobium part at a higher temperature exposed to the interior of the arc tube, joined to a titanium part at a lower temperature is superior. Titanium alone could not be used as a structural member at the higher temperatures because of grain growth and recrystallization. Also vaporization of titanium can be a problem at temperatures above 1000° C. In addition titanium is not matched in thermal expansion to alumina ceramic and undergoes a phase change at about 880° C so that it is not suitable for end cap 11. However it can be used for flexible metal strap 23 in the FIG. 1 construction or for connector 17 in the FIG. 2 construction. Niobium is far superior for the end seals because its coefficient of thermal expansion is a close match to that of alumina ceramic. The exhaust tube and dummy tubes 12, 13 may well be made of tantalum as an alternative to niobium, in which case the getter chain would comprise niobium end cap, tantalum tube, tantalum strap or connector, and titanium support rod.

When titanium is used as a getter at temperatures below 400° C, a surface oxide can form which will prevent sorption of gaseous hydrogen. My invention by using another material, namely niobium, bonded to the titanium and operating at a higher temperature, avoids this limitation so that sorption of hydrogen can take place at the higher temperature. The hydrogen sorbed by the niobium can be transported by diffusion to the titanium at the lower temperature. In the illustrated lamp the niobium end cap 11 and metal tube 13 are in contact with the gaseous atmosphere within the arc tube. Hydrogen in the discharge space deleteriously affects lamp performance in starting and operation. The niobium end structure operating as the first link in the getter chain can withdraw hydrogen from the discharge space and move it by diffusion along the flexible metal strap 23 to the titanium support rod 22 wherein it is stored along with other contaminants.

It is important to use high purity titanium for rod 22 in order to maximize its sorption ability. Suitable material is titanium corresponding to American Welding Society specification A 5.16-70 ERTi-1 wherein maximum impurities allowed are carbon 0.03%, oxygen 0.10%, hydrogen 0.005%, nitrogen 0.012% and iron 0.10%.

Experience has shown that the weld or joint between the lead-in conductor 6 which is normally made of nickel or nickel-iron alloy and the titanium support rod 22 is often brittle. In lamps subject to considerable vibration and particularly in larger heavier sizes of lamps such as the 1000 watt size, the weld may be too weak and may break. Accordingly in such lamps the titanium getter should be arranged to operate in the same fashion as described earlier but without filling any structural role.

Figure 3:
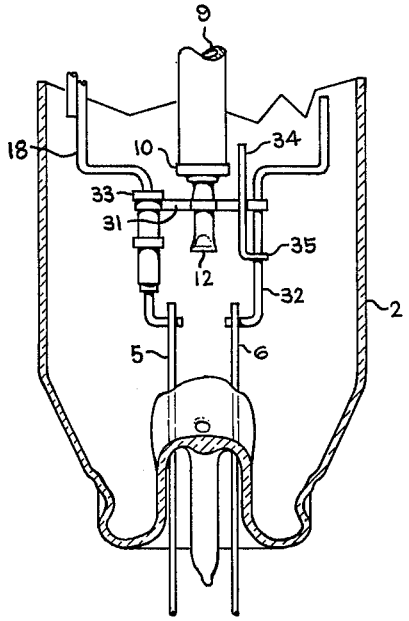
FIG. 3 is a detail of another base-down lamp embodying the invention.

A suitable arrangement for a non-structural niobium getter is illustrated in FIG. 3 which shows the lower end of a 1000-watt high pressure sodium vapor lamp designated commercially LU-1000. Where the structure is unchanged relative to FIG. 2, the same reference numerals are used to identify corresponding parts. The lower end of the arc tube is supported through sealed off niobium exhaust tube 12 to which is welded a double cross-strap 31 of niobium. The strap is welded at one end to short nickel-iron rod 32 and wraps around an insulator 33 at the other end for additional support. Insulator 33 is supported on long side rod 18 which is threaded through it. In this construction the heavy lead-in conductors 5, 6, the short rod 32 and the long side rod 18 are all of nickel-iron alloy and serve as structural members and current conductors. The titanium getter 34 extends parallel to rod 32. It is spot-welded to niobium strap 31 and has a right-angled short portion 35 spot-welded to rod 32. The distal end of getter 34 extends to the vicinity of end cap 10 in order to receive heat from the arc tube. This arrangement provides the desired temperature conditions for effective gettering, namely the intermediate niobium member 31 (group VB) at a higher temperature, and the titanium getter member 34 (group IV B) at a lower temperature, so that hydrogen sorbed by the niobium can be transported by diffusion to the titanium. The titanium member 34 has no structural function so that the welds or joints between it and titanium strap 31 and nickel-iron rod 32 are not under any strain which might cause fracture.

During the lamp manufacture and prior to the first lighting of the lamp it is common for the titanium to absorb certain impurities, for instance oxygen and hydrogen while the outer jacket glass is being worked with flames. These impurities can inhibit the gettering properties of the titanium. The way to overcome this problem in the past has been to heat the titanium by radiation from outside the lamp jacket while the lamp is being pumped prior to the final seal-off. This releases the volatile gases and activates the surface of the titanium by allowing the surface oxides to be dissolved into the bulk of the material. However the use of a two-metal getter structure with portions operating in different temperature ranges in accordance with my invention has reduced the need for such treatment and made it optional.

When the lamp is first lighted and thereafter in operation, the various parts of the lamp structure release gaseous impurities which would be deleterious to lamp performance. The niobium-titanium getter structure of the invention removes these impurities and maintains the lamp jacket at a high degree of vacuum thus assuring the intended lamp performance. Analysis of the outer envelopes of prior art lamps using evaporated barium films for getters have shown that even with careful control of the getter ring location and orientation, some barium is found in all parts of the envelope. This scattered barium absorbs light and tests have shown that as much as 8% of the light from the discharge can be lost because of the barium fill. Such losses are avoided by my invention. In the 400-watt size of high pressure sodium vapor lamps corresponding to the lamp illustrated, I have measured efficacies over 130 lumens per watt, and in the 1000-watt size, efficacies over 150 lumens per watt. These figures represent gains of better than 5% over the efficacies measured in otherwise similar lamps using the prior art style of barium-aluminum alloy powder flash getter.

What I claim as new and desire to secure by Letters Patent of the United States is:

1. A high pressure alkali metal vapor discharge lamp comprising:

an outer vitreous envelope having a base attached thereto and a pair of inleads sealed into said envelope and connected to said base, said outer envelope being evacuated;

an inner envelope of alumina ceramic having sealing closures at opposite ends supporting electrodes therein and affording connections thereto;

said inner envelope containing an ionizable medium including alkali metal;

a mounting frame supporting said inner envelope within said outer envelope, and including conductors connecting said inleads to said sealing closures;

and at least one of said closures comprising a portion of group VB metal, a connector extending from said group VB portion to a getter member of group IV B metal and operating at a lower temperature than said portion, said connector being of metal from group VB and IV B, whereby said getter member serves as a lower temperature getter and reservoir for contaminants.

2. A lamp as in claim 1 wherein said one closure operates in the temperature range from approximately 500° to 1100° C, and said getter member operates in the temperature range from 200° to 500° C.

3. A lamp as in claim 1 wherein said one closure has a portion chosen from niobium, tantalum and alloys thereof; said connector is chosen from niobium, tantalum, vanadium, zirconium, titanium and alloys thereof; and said getter member is chosen from titanium, zirconium and alloys thereof.

4. A lamp as in claim 1 wherein said mounting frame comprises a side rod extending from one inlead towards the opposite end of the outer envelope and a short support rod of metal from group IV B extending from the other inlead and serving as said getter member.

5. A lamp as in claim 1 wherein said one closure is at least in part of niobium, said mounting frame includes a side rod extending from one inlead towards the opposite end of the outer envelope and a short support rod of titanium extending from the other inlead and serving as said getter member, and said connector extending from said niobium closure part to said titanium support rod is of niobium.

6. A lamp as in claim 1 wherein said one closure comprises a niobium portion, a niobium connector connects said portion to one of the conductors of said mounting frame, and titanium getter member is connected between said niobium connector and said one conductor of said mounting frame.

7. A high pressure alkali metal vapor discharge lamp comprising:

an outer vitreous envelope having a base attached thereto and a pair of inleads sealed into said envelope and connected to said base, said outer envelope being evacuated;

an inner envelope of alumina ceramic having sealing closures at opposite ends supporting electrodes therein and affording connections thereto;

said inner envelope containing an ionizable medium including alkali metal;

a mounting frame supporting said inner envelope within said outer envelope, and including conductors connecting said inleads to said sealing closures;

one of said closures being at least in part of metal selected from niobium and tantalum, a connector of metal selected from niobium and tantalum, and a titanium member attached to said frame and operating at a lower temperature than said one closure, said connector extending from said metal part of said one closure to said titanium member whereby said titanium member serves as a lower temperature getter and reservoir for contaminants.

8. A lamp as in claim 7 wherein said titanium member forms a short rod extending from said one inlead.

9. A lamp as in claim 7 wherein said titanium member extends alongside a conductor of said frame and has one attachment to said conductor and another attachment to said connector.

10. A lamp as in claim 7 wherein said one closure comprises a tube of metal selected from niobium and tantalum and said connector is bonded to said tube.

11. A lamp as in claim 7 wherein said one closure comprises a metal end cap through which extends a tube of metal selected from niobium and tantalum to which said connector is welded.

* * * * *